United States Patent [19]

Fehlmann

[11] 4,139,670

[45] Feb. 13, 1979

[54] COMPOSITE PANEL MATERIAL WITH METAL SKELETON

[75] Inventor: Hans-Beat Fehlmann, Walchwil, Switzerland

[73] Assignee: Loewe Anstalt, Switzerland

[21] Appl. No.: 744,263

[22] Filed: Nov. 23, 1976

[30] Foreign Application Priority Data

Nov. 24, 1975 [CH] Switzerland ..... 15173/75

[51] Int. Cl.[2] ..... B32B 3/30; B32B 3/28

[52] U.S. Cl. ..... 428/167; 52/793; 52/630; 428/172; 428/178; 428/179; 428/604; 428/614; 156/309

[58] Field of Search ..... 428/132, 137, 172, 179, 428/70, 71, 72, 621, 603, 614, 604; 52/630, 618

[56] References Cited

U.S. PATENT DOCUMENTS

| | | | |
|---|---|---|---|
| 3,008,551 | 11/1961 | Cole | 428/132 |
| 3,544,417 | 12/1970 | Corzine | 428/71 |
| 3,812,636 | 5/1974 | Albrect et al. | 52/630 |

FOREIGN PATENT DOCUMENTS 565,212 8/1958 Belgium.

*Primary Examiner*—George F. Lesmes
*Assistant Examiner*—P. Thibodeau
*Attorney, Agent, or Firm*—Holman & Stern

[57] ABSTRACT

Composite panels that include a metal skeleton of two superposed metal plates or sheets having groups of protruding bridge-shaped elements that extend into the interspace between the plates or sheets and overlap in a manner to form one or more elongated cage-like columns; a coherent matrix material made of a flowable or pourable mineral and/or organic matrix precursor is provided to substantially fill the interspace to form a substantially rigid compound structure of the panel constituents due to the plate-interlocking function of the cage-like columns. The panels can be flat or curved and are suitable as structural materials, notably as load supporting walls for buildings. Methods for producing such composite panels in a batchwise or continuous operation are disclosed.

15 Claims, 6 Drawing Figures

COMPOSITE PANEL MATERIAL WITH METAL SKELETON

FIELD AND BACKGROUND OF THE INVENTION

This invention generally relates to structural materials of the type suitable for building purposes and specifically to composite panel materials that include a metal skeleton structure.

Metal skeleton type panel materials are known in the art of vehicle and aircraft construction and attempts have been made to use such panels for building purposes. For example, the panels disclosed in Belgian Pat. No. 565,212 (J. Couelle) are intended as load-bearing walls for building purposes and consist of a metal skeleton of two metal plates spaced apart in parallel planes, each plate comprising a plurality of elements that extend into the space between the two plates and are intended to stiffen the skeleton structure. One or both of the external surfaces of these prior art panels can be provided with coatings of a porous solid material, such as gypsum or concrete, and each plate is equipped with a large number of tongues formed, for example, by punching-out and bendingly deforming portions of the plates. At least some of these tongues extend into the space between the plates but may also project from the outside of the skeleton to improve adhesion of the porous coating of the skeleton. Bracing or stiffening of the skeleton is achieved by interconnecting the ends of the tongue-shaped elements projecting from both plates by electrical welding.

Skeleton-type panels for vehicles or aircrafts are disclosed in French Pat. No. 1,045,315 and are made of two parallel metal plates. Bracing elements are provided between the plates and these elements can be formed as separate elements or on either or both plates, and are connected to the other plate, or to both plates, by electrical welding or by means of an adhesive.

Aside from the problems of connecting the bracing elements with each other or with the plates, such prior art panels do not provide for a sufficient load-bearing capacity, i. e. the mechanical strength of a vertically arranged panel under the impact of a load applied vertically at the top surface of the panel, if sheet metal plates of commercially feasible — i. e. as viewed from the cost of materials in the building industries — qualities and gauges of the metal plates as well as commercially acceptable manufacturing methods are to be used. This is due to the fact that the load-bearing capacity of prior art panels is substantially limited by the load-bearing capacity of conventional metal skeletons, i. E. their lack of resistance against buckling, when used as load-supporting walls. Furthermore, joining of the bracing elements with each other or with an adjacent plate tends to present substantial problems of manufacture.

OBJECTS AND SUMMARY OF THE INVENTION

Thus, a main object of the invention is a novel and improved panel material for use in the building industry.

A further object of the invention is a novel composite material comprising a metal skeleton in a compound structure having an integral load-bearing capacity that is substantially improved over that of its components.

Another object is a novel composite formed of a predominant portion of a non-metallic matrix made of commercially available, low cost materials and a small volume portion of conventional sheet metal in the form of a metal skeleton compounded with said matrix so as to enable substantial utilization of the inherently high compressive strength of the metal portion, i. e. to an extent of 50% or more.

Still another object is an improved manufacture of composite panels.

Further objects will become apparent as the specification proceeds.

The invention, in a first general embodiment, provides a composite panel material comprising a metal skeleton formed of two metal plates arranged in substantially parallel planes, each of said plates being provided with at least one group of substantially isomorphous bridge-shaped elements protrudingly extending from said plate into an interspace between said to plates, each of said bridge-shaped elements having a longitudinal dimension and a lateral dimension, said group of bridge-shaped elements extending in a main direction substantially perpendicular to said longitudinal dimension of said bridge-shaped elements constituting said group, said bridge-shaped elements of said group being arranged with their longitudinal dimensions substantially parallel to each other, each two adjacent bridges of said group being separated by a distance that is at least as large as said lateral dimension, said two plates being arranged so that said bridge-shaped elements of said group on one of said two plates at least partially overlap with said bridge-shaped elements of said group on the other of said two plates; and a coherent matrix material provided within said interspace to form a substantially rigid compound structure of said metal skeleton and said matrix material.

DEFINITION OF TERMS

"Panel materials" are stratiform structures, preferably of a substantially uniform thickness and typically in the range of from about 10 mm to about 200 mm, that may be flat, curved or bent.

"Composite panels" are integral structures including at least two component materials in a joined relation.

The term "metal plate" is intended to encompass metal sheetings and similar structures made of normally solid structural metals, such as iron, iron alloys including steel, aluminum or the like, with a typical gauge in the range of from about 0.2 mm to about 10 mm, preferably from about 0.5 mm to about 5 mm.

The term "matrix" as used in this context is intended to include any normally solid and generally at least somewhat porous material consisting of, or containing, inorganic and preferably mineral or/and organic constituents capable of being made by chemical or physical solidification of a flowable or pourable (liquid, semi-liquid or particulate solid phase or mixtures of such phases) matrix precursor. While specific non-limiting examples will be given below, a matrix according to the invention generally can be defined as a coherent phase capable of maintaining a substantially rigid compound structure with the metal skeleton.

"Porosity" of the matrix in this context includes microporous, macroporous and cellular structures.

The term "bridge-shaped" is intended to include geometrical shapes that constitute a continuous mechanical connection of two areas of a base-plane with a portion of the connection being outside of the base-plane.

The term "isomorphous" is intended to include identical shapes as well as shapes of sufficient similarity — notably with regard to their maximum elevation from the plates — to provide for their capacity of forming the mutual overlap arrangement believed to be essential for establishing the cage-like columns of inventive composite panels.

DRAWINGS AND DETAILED EXPLANATION OF INVENTION

Preferred embodiments of the invention will now be explained with reference to the drawings in which FIG. 1 is a semi-diagrammatic illustration of one of the metal plates of the skeleton as viewed from that side of the plate where the bridge-shaped elements protrude;

Figure 1:
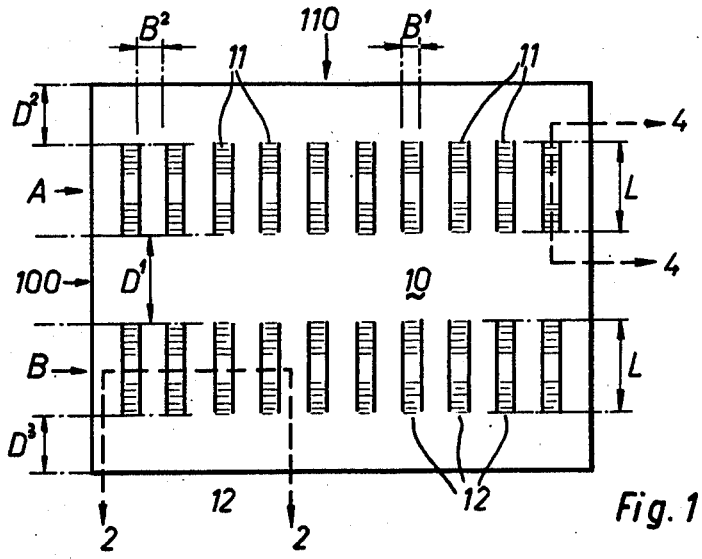

In FIG. 1, plate 10 is shown in plan view with the isomorphous or like-shaped bridges 11, 12 projecting upwards out of the plane of the drawing. Beneath each bridge is a perforation of plate 10 approximately corresponding to the projection of the bridge into the plane of the plate. Each bridge consists of a bent-out strip formed between a pair of parallel cuts or slits in plate 10. Generally, the strip is formed in a bridge-like shape by drawing the plate material between the slits. Thus, each bridge-shaped protrusion constitutes a longitudinally continuous, cohesive, stirrup-shaped bulging out strip of plate 10 and the actual surface length of the bridge will be somewhat greater than the length of the perforation, depending upon the degree of deformation of the strip by drawing. In practice, however, it is the projected bridge length that is considered as the longitudinal dimension of the bridge. According to this illustration, the bridges are arranged in two substantially rectangular patterns of parallel and mutually distanced band-like groups A, B. The distance $B^2$ between to adjacent bridges in a row is preferably uniform and the bridges lie parallel to one another in the direction indicated by the arrow 110. The main directions of groups A, B extend parallel to one another and to the direction indicated by arrow 100, which in turn is practically perpendicular to the direction indicated by arrow 110. The distance $B^2$ between each two adjacent bridges 11 in a group is at least equal to the width $B^1$ of each of these bridges so as to provide for the intermeshing and overlapping bridge arrangement of the bridges of two plates as shown and superimposed with the bridge-shaped protrusions of one plate extending towards the bridge-protruding side of the other plate.

The distance $D^1$ between groups A, B is approximately equal to the length L of the perforations beneath the bridges 11, 12, i. e. the projection of the web length of the bridges into the plane. The length of this projection will be designated here as the bridge length or longitudinal dimension of the bridge-shaped elements, respectively. Since the distances $D^2$, $D^3$ between the side edges of plate 10 and the upper boundary of group A and the lower boundary of bridge group B, respectively, are each equal to about one half of the bridge length L, approximately 50% of the material cross-section of the sheet 10, as viewed in the direction indicated by arrow 100, constitutes zones of material which are continuous, that is uninterrupted by perforations beneath bridges 11, 12. In a corresponding manner, cross-sectional regions $B^2$ are not interrupted in the direction of arrow 110 due to the aligned arrangement of the bridges in groups A, B and at least about 50% of the material cross-section of plate 10 are not interrupted by perforations in the direction of arrow 110. Preferably, each plate consists of bridges to an extent of at least 20% of its surface area and up to about 60% or more. As will be apparent to the expert, these percentages are not critical per se and variations may be made depending upon end use requirements, costs and manufacturing methods employed. Preferably, the cross-sectional area of a plate, viewed in any plane vertical to the plate, consists at least of about 20% of metal in the sense that the perforated portion of such cross-sectional area does not exceed about 80%.

While plate 10 is provided with two continuously patterned groups of bridge-shaped elements, three or more of such groups can be provided on each plate. Also, each pattern or group may be discontinuous, i. e. made of pattern segments.

Figure 2:
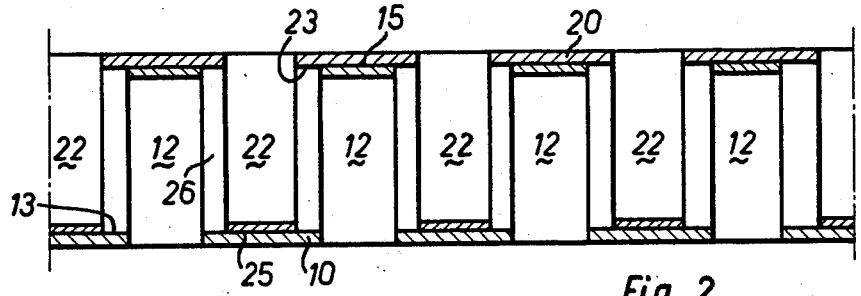
FIG. 2 is an enlarged sectional view along 2—2 of FIG. 1 with a second plate in a superimposed arrangement for intermeshing and overlapping of the bridge-shaped elements.

The cross-section along 2—2 of FIG. 1 represented in FIG. 2 shows plate 10 and some of its projecting bridge-like elements 12 together with a second plate 20 superimposed on plate 10 to constitute the skeleton structure the bridges 22 intermeshed with bridges 12. The structure of plate 20 is the same as that of plate 10 with two groups of bridges 21, 22 arranged in continuous rectangular patterns.

In contrast to prior art skeleton structures as disclosed in the above mentioned patents, a particular connection of the bracing elements with each other or with the superimposed plate, e. g. by electrical welding, is not required according to the invention. This is extremely important from a manufacturing point of view and the composite panels of this invention can be made in a single step from prefabricated sheets by filling the interspace of superimposed plates in the intermesing and overlapping arrangement of the bridges with a suitable matrix precursor and solidifying the latter. Surprisingly, this lack of a particular metal/metal bond between the skeleton plates has no negative impact upon the load-bearing capacity of the subject composites and a substantial increase of the load-bearing capacity can be achieved due to a synergistic interaction between the skeleton and the matrix according to the invention.

If, according to a preferred embodiment of the invention, two practically identical plates of the type shown in FIG. 1 are superimposed with their bridges towards one another to form the serrated arrangement of bridges 12, 22 indicated in FIG. 2, a maximum overlap of the free areas under the bridge or longitudinal bridge section areas will be achieved. For illustration, the overlapping region, that is area 31, is shown more closely shaped in the drawing although the actual density of the matrix in the entire interspace 33 between plates 10, 20 and including the overlap area 31 is substantially uniform.

Figure 3:
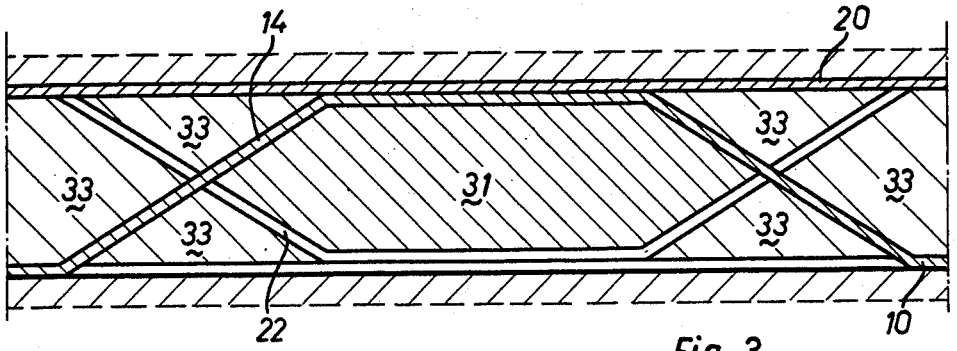
FIG. 3 is a semi-diagrammatic sectional view of that portion of a panel according to the invention where the bridge-shaped elements overlap.

The preferred bridge pattern arrangement of groups A, B (FIG. 1) or analogous patterns with three or more groups provides for a skeleton structure illustrated in FIGS. 2 and 3 and two or more bridge-overlap regions extending in direction 100 through the skeleton will result when two plates 10, 20 are in the superimposed relation. These overlap regions act as longitudinal cage columns around the matrix and this is believed to be essential for the high load-bearing characteristics of the composite panels according to the invention, notably in view of the absence of a metal/metal bond, e. g. by welding between the plates of the skeleton. Each longitudinal bridge group of one plate forms such an elongated cage with the overlappingly arranged bridge groups of the other plate. Composite panels according to the invention can be provided with only one such cage or with three or more cages, depending upon the overall dimensions of the plate and each cage preferably extends over a substantial portion of each plate. The cross-sectional area contained by the cage or cages in direction 110, that is, parallel to the longitudinal axes of the bridges and perpendicular to the plane of the plates, or the ratio of the size of this cross-sectional area to the corresponding total cross-sectional area of the matrix-filled interspace between the plates will have an influence upon the strength of the compound structure. Accordingly, the maximum bridge-overlap that can be attained with any given shape of the bridges will be preferred in general. The absolute size of the overlapping area depends, of course, upon the geometry of the free bridge area, when viewed in longitudinal section. A substantially total bridge-overlap could be achieved with bridge-shaped elements having lateral portions that extend vertically to the plate, but this is less preferred as it may reduce resistance of the panels to shear forces acting in the planes of the plates and in view of the preferred manufacture of the bridges by punching and drawing the plate material.

Figure 4:
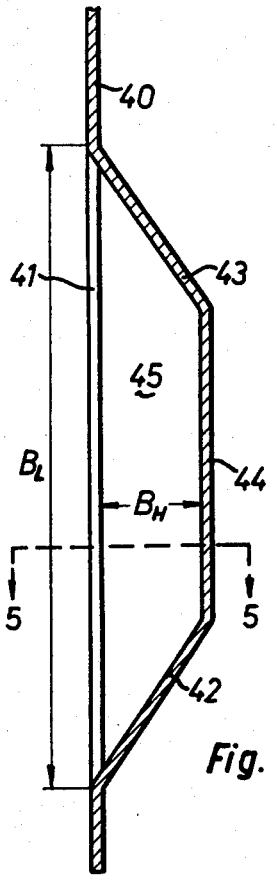
FIG. 4 is a semi-diagrammatic illustration of a single bridge-shaped element on one of the skeleton plates in longitudinal section.

An approximately trapeze-shaped form of the bridges as shown in FIGS. 3 and 4 is preferred for these reasons and provides for a maximum bridge-overlap of about 70% based upon the longitudinal sectional area of the bridges. Bridge-overlaps of at least 50% are generally preferred. Based upon the entire cross-sectional area of the plate interspace in the corresponding plane, a total overlap area of at least about 20% is preferred for most purposes.

As indicated, the cage columns formed by the overlap of the bridge groups are important for the load-bearing capacity of the composite panels according to this invention. While not wishing to be bound to a specific theory, this is believed to be due to the action of the matrix portion contained by the cages. Even a matrix having little mechanical strength, e. g. a coherent porous phase of a low-strength material, will effectively support and interlock the skeleton plates because the matrix within the cage will be mainly loaded in compression and shear and hardly at all in tension, when the composite panel is subjected to a buckling stress or load. Since such compression and shear forces can be distributed by the surrounding plate surface of the cage columns over large volumes and areas, matrix materials can be used that have a relatively low intrinsic strength and little or no load-bearing capacity, for example a matrix material having a compressive strength (at 10% compressive strain) of only 1-2 kg/cm$^2$ and a shear strength of only 1 to 1.5 kg/cm$^2$, while the composite panel thus obtained will have a compressive strength about twice as large as that of normal bricks.

A suitable dimensioning of the bridges is desirable for the above mentioned force distribution and will be explained in FIG. 4 and together with the preferred geometry of the bridge-shaped elements. In a metal plate 40 the material suituated between two parallel cutting locations 41 is deformed for example by pressing and deep-drawing to constitute the trapeze-shaped bridge having two oblique lateral web portions 42, 43 and a straight central web portion 44. Area 45 is encompassed by bridge web portions 42, 43, 44 and the plane of the plate 40, and it is this area that is essential in regard to form and size of the bridge overlap explained above. The bridge area of main importance here is the free longitudinal sectional area of the bridge. Its geometry is substantially determined by, and similar to, the outer shape of the bridge.

Since the volumetric portion of the metal skeleton in relation to the total volume of the composite panel should be kept small for reasons of economy, for example to 5% or less, low gauges of the plate are preferred. For many end uses and a generally preferred range of thickness of the panel, plates having a gauge or thickness of about 0.5 to 3 mm are suitable. Optimum bridge dimensions may be influenced by the specific gauge of the plate and the deep-drawing or cupping capability of the plate material. The following minimum ratios have been found to be suitable for many purposes:

| | | |
|---|---|---|
| lateral bridge dimension or bridge width ($B_B$) | thickness or guage of plate | 15:1 |
| elevational bridge dimension or bridge height ($B_H$) | thickness or guage of plate | 30:1 |
| longitudinal bridge dimension or bridge length ($B_L$) | thickness or guage of plate | 200:1 |

The actual total web length of each bridge (two lateral web portions plus central web portion) is always somewhat greater, for example by about 10%, than the projected length of the web portions into the plane of the plate and is preferably at least about 10 times larger than the width of the webs. The central web of each bridge is preferably at least as long as each of the lateral webs.

The distance between two adjacent bridges of a group is always at least as large as the lateral bridge dimension, said lateral bridge dimension referring to the maximum width of the bridge if such width varies over the length of the bridge. As a rule, said distance is not greater than about three times the lateral bridge dimension and preferably not greater than about twice said lateral dimension.

A practically constant web width is preferred over the length of the bridge, but this is not critical as long as a sufficiently large unperforated plate area is maintained.

Figure 5:
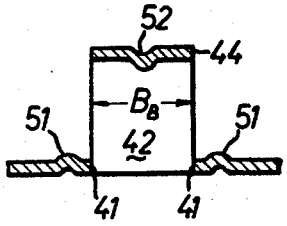
FIG. 5 is a sectional view along 5—5 of FIG. 4.

As shown in FIG. 5, plate 40 may be furnished with bracing or stiffening grooves 51 that extend parallel to each bridge and adjacent to the cut edges 41. Bridge webs 44 may also possess one or more stiffening grooves 52. Apart from providing additional stiffening for the plates, this is a simple method of producing plates that can be stacked closely for storage or transport prior to manufacture of the panels.

The upper face of web middle portion 44 need not be flat and may have some curvature as indicated in the cross-section shown in FIG. 5 because substantially flat contact areas for firm bonding with a superimposed plate are not required.

Figure 6:
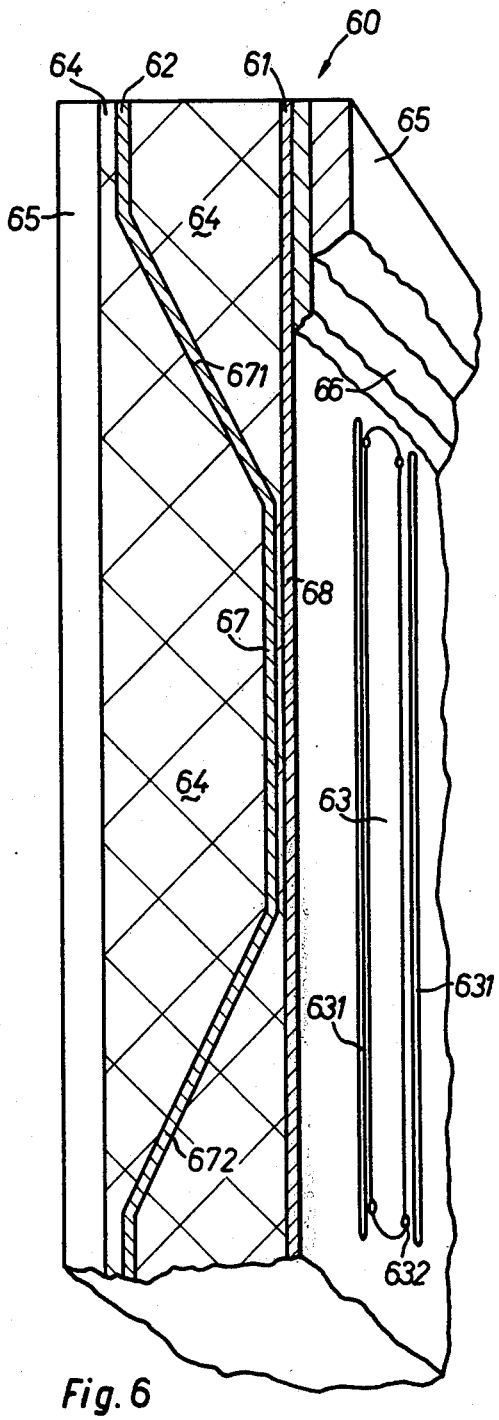
FIG. 6 is a partially cut-away perspective view of a portion of one embodiment of the composite material according to the invention.

The semi-diagrammatic perspective view of FIG. 6 shows a portion of a preferred composite panel 60 according to this invention and comprises a metal skeleton formed of plates 61, 62 with a number of optional layers 64, 65, 66 of a porous solid material for coating and/or heat insulating purposes. The frontal sectional surface is parallel to the longitudinal extension of the bridges on plate 62, the bridges having lateral web portions 671, 672 and a central web portion 67. Of the corresponding overlappingly arranged counter-bridge on plate 61 only the plate perforation or aperture 63 can be seen from which this bridge is formed. The interspace between plates 61, 62 is filled with matrix 64. As a consequence of the above-explained effect of the cage column of a plurality of overlappingly arranged bridges, the matrix forms a substantially rigid compound structure with plates 61, 62 even though no particular connection is provided at interface 68 between the upper face of web portion 67 and plate 61. Some adhesive effect may occur at interface 68 as a consequence of matrix precursor material that has penetrated into the interface but such adhesion is not stronger than the adhesive or bonding connections occurring at all the other interfaces between plates 61, 62 and matrix 64.

The outer face of plate 62 carries two superimposed layers 64, 65 of porous solid material of which the inner layer 64 can be of the same material as matrix 64 and can be formed together with the latter. Depending upon the type of the surface quality desired, outer layer 65 may be made of a denser or harder material than matrix 64. Preferably, the outer face of plate 61 is covered by one or more covering layers in a similar manner.

In the area of plate 61 where the covering layers 65, 66 have been broken away for illustration, stiffening grooves 631 provided on either side of perforation 63 are shown as well as punched-out openings 632 provided to facilitate formation of the bridges by drawing.

As an illustrative example, a composite panel of the type shown in FIG. 6 was made with an overall thickness of about 80 mm (metal plate thickness = 0.75 mm, $B_L$ = 230 mm, $B_H$ = 30 mm, $B_B$ = 15 mm) of normal commercial steel sheeting (St 37) and polyurethane foam as the matrix and covering material. While the steel skeleton constitutes less than 3% of the total volume of the panel, loads of up to 10 metric tons per meter of wall length were supported by the panel when tested as a load-bearing wall (height of test piece approximately 2 meters, width of test piece approximately 50 centimeters, buckling length approximately 2 meters), both when loaded parallel to the longitudinal direction of the bridges and when loaded transversely to that direction.

Composite panel materials according to this invention provide considerable advantages from a manufacturing point of view. The preformed metal plates are capable of close stacking to facilitate transport and storing. Many suitable matrix precursors are available commercially and can be transformed into a suitable matrix by conventional means. The panels can be produced in a batchwise or continuous operation. According to the invention, at least one metal plate of the type disclosed herein is supportingly arranged on a surface member so that the bridges of the plate extend in a direction away from the surface member. A second metal plate is arranged on the first plate so as to overlappingly intermesh the bridges of the first and the second plate. A flowable matrix precursor material is provided on the first plate prior, during or after arrangement of the second plate thereon. Finally, the matrix precursor is solidified to form the coherent matrix of the compound structure. The surface member may be part of a mold cavity that essentially corresponds with the shape of the panel in its uncoated, partially coated or completely coated state and that is capable of receiving both of said plates in the overlappingly intermeshed bridge arrangement. Then, the flowable matrix precursor material is introduced into the mold cavity and is solidified therein so as to produce the compound matrix. Prior to introducing the matrix precursor material, or thereafter, and in any case prior to solidification, both plates can be bent while in the intermeshed arrangement so that the final panel will have a curvature or bent structure.

Alternatively — for continuous production — the surface member may be a continuous support means, e. g. a conveyor belt or the like, capable of receiving a continuous stratum formed of a plurality of interconnected first plates, e. g. formed by intermeshed overlap at the end portions. A second continuous stratum of second plates can be formed in a similar manner and arranged on the first stratum so as to form an overlappingly intermeshed bridge arrangement of the first and the second stratum. The flowable matrix precursor is applied onto the plates of the first stratum prior or during superimposition of the second stratum. In this manner, a strip of panel material can be produced from a plurality of plates. Instead of interconnecting a sequence of plates for forming either stratum, the plates can be produced as a strip or web provided with the bridge-shaped protrusion and processed in an analogous manner to form a continuous composite panel material of any desired length.

As briefly mentioned above, the coherent matrix material may consist partially or entirely of inorganic, for example mineral, material or partially or entirely of organic material, for example synthetic polymeric compositions. In general, the coherent matrix will have some degree of porosity, i. e. include a large number of small or even minute "voids", e. g. cellular gas-containing enclosures in a more or less uniform distribution within the matrix phase. The gaseous enclosures may contain air, carbon dioxide, nitrogen or similar gases or gas mixtures. The coherent matrix phase may have a relatively homogeneous foam structure of inorganic and/or organic substances or a heterogeneous structure, for example consisting of a large number of porous particles interconnectingly bonded by, or embedded in, a solid which in turn may, or may not, have a porous or microporous structure. For example, such particles may form a coherent matrix by local interbonding with a binding agent. Suitable coherent matrices can be formed, for example, from granular or filler type materials and suitable binding agents such as, for example, from expanded mica, expanded clay and the like, with "water-glass" (aqueous solutions of water soluble alkali silicates), cement and the like as binding agent, optionally with additions of suitable solid, liquid or gaseous hardeners known in the art. Inert waste or scrap materials, generally in a particulate or comminuted state, are suitable as well as a granular matrix constituent. Concretes, notably aerated concretes or gas-foamed concretes, are further examples of suitable matrix materials.

Organic binders can be combined with inorganic fillers, or vice versa, in the coherent matrix. Another suitable type of matrix may be made, partly or entirely, of fluid or flowable compositions used in the art of producing synthetic polymer foams, e. g. polyurethanes such as those obtained from polyisocyanates and polyhydroxy compounds with various types of blowing agents, with or without the addition of fillers and other conventional additives. Such polyurethanes as well as phenolic resins, urea resins, polymethacryl imides, polyvinyl chlorides, polystyrenes and the like polymers or copolymers of the group of thermosetting (i. e. cross-linked and thermoplastic synthetic polymers) can be used as foams or binding agents.

Porosity of the matrix may thus be achieved simultaneously with solidification of the precursor in the course of the production methods disclosed, e. g. by foaming as induced by a blowing agent, by "sinter-type" local bonding of a bulk of particulate solids or by evaporation of a liquid. Alternatively, or in addition to any such pore-forming mechanism, inherently porous materials, e. g. of the type mentioned above, may be used as a constituent of the matrix or of the matrix precursor.

Numerous other matrix materials on a mineral or/and synthetic organic base will be apparent to the expert. Generally, a matrix material suitable for the invention will be capable of being formed from a precursor material that is not a coherent solid and may be a liquid, a paste, a pourable solid, a slurry or other type of pourable or fluid solid/liquid — or solid/solid — mixture.

Some matrix precursors are inherently self-bonding, such as a conventional polyurethane foam precursor or any conventional inorganic or organic cement, while others include a mixture of a binder constituent and a non-bonding solid. It is to be noted that the binding or self-bonding function can be due to chemical reactions but this is not believed to be critical and non-chemical solidification, such as by solvent evaporation, of the matrix precursor is to be encompassed by the invention.

The main criterion of the matrix phase is believed to be its coherence in the sense of forming the substantially rigid compound structure with the skeleton plates, that is, a minimum of shear strength, e.g. at least about 1 $kg/cm^2$. No inherent load bearing capacity is required for the matrix and matrix materials having a very low compressive strength, e.g. 1 $kg/cm^2$ (at 10% compressive strain) are suitable. Thus, low-density and low-cost matrix materials can be used as the main volume portion of inventive panel materials having high load bearing characteristics.

Secondary criteria of the matrix phase may depend upon specific end use requirements for the panel, e. g. low or no flameability, thermal and/or acoustic insulation, physical and chemical resistance, and the like characteristics of conventional building materials.

Many other variations will be apparent to the expert. For example, while the metal plates of the skeleton are preferably made of sheet steel, other metals or alloys are suitable as well, and the plates may be treated for corrosion protection and/or improved bonding with the matrix.

What is claimed is:

1. A composite panel material comprising a metal skeleton formed of two metal plates arranged in substantially parallel planes with an interspace between said plates, each of said plates being provided with at least one group of substantially isomorphous bridge-shaped elements protrudingly extending from said plate into said interspace between said two plates, each of said bridge-shaped elements having a longitudinal dimension and a lateral dimension, said group of bridge-shaped elements extending in a main direction substantially perpendicular to said longitudinal dimension of said bridge-shaped elements constituting said group, said bridge-shaped elements of said group being arranged with their longitudinal dimensions substantially parallel to each other, each two adjacent bridges of said group being separated by a distance that is at least as large as said lateral dimension, said two plates being arranged so that at least some of said bridge-shaped elements of said group on one of said two plates fit between and at least partially overlap with said bridge-shaped elements of said group on the other of said two plates to form an elongate cage-like enclosure between overlapping portions of the respective groups of bridge-shaped elements, said enclosure extending in said main direction; and a matrix material substantially fillng said interspace and bonding said plates into a substantially rigid coherent structure.

2. The material of claim 1 wherein each of said plates is provided with at least two of said groups of bridge-shaped elements, each of said groups including said bridge-shaped elements in a substantially rectangular pattern and each pattern being spaced apart from the other.

3. The material of claim 2 wherein said main direction of one of said groups is in a substantially parallel alignment with said main direction of the other of said groups, while said longitudinal dimensions of said bridge-shaped elements of the one of said groups on one of said plates are arranged in perpendicular alignment with said longitudinal dimensions of said bridge-shaped elements of the other of said groups on said plate.

4. The material of claim 3 wherein said groups on said one of said plates are separated by a distance which is at least as large as one half of said longitudinal dimension of said bridge-shaped elements.

5. The material of claim 1 wherein each of said bridge-shaped elements extends over an essentially rectangular opening in said metal plate substantially defined by a pair of parallel cutting lines in said plate.

6. The material of claim 5 wherein at least about 20% and not more than about 60% of the total surface area of each of said plates consist of said essentially rectangular openings.

7. The material of claim 6 wherein any cross-section of said plates viewed in planes perpendicular to said plates consists of not more than about 80% of said openings.

8. The material of claim 1 wherein each of said bridge-shaped elements has a substantially trapeze-like shape if viewed in a sectional plane that is prependicular to said planes of said metal plates and parallel to said longitudinal dimension.

9. The material of claim 8 wherein a center portion of said bridge-shaped elements on said one of said plates is bondingly connected with said other of said plates in areas between said bridge-shaped elements on said other of said plates.

10. The material of claim 8 wherein said trapeze-like shape of said element comprises a middle-web portion and two adjacent side-web portions, said middle-web portion being at least as long as the combined lengths of said side-web portions.

11. The material of claim 1 wherein said longitudinal dimension of each of said bridge-shaped elements is at least about five times larger than said lateral dimension.

12. The material of claim 1 wherein said plates are capable of being stacked.

13. The material of claim 1 wherein said solid matrix material has a shear strength of at least 1 kilogram per square centimeter.

14. The material of claim 1 wherein said plates are provided with a plurality of grooves extending parallel to said longitudinal dimension and serving to stiffen said plates.

15. The material of claim 1 wherein at least one external face of said metal skeleton is provided with a layer of a porous solid material.

* * * * *